US005325741A

United States Patent [19]

Astrom

[11] Patent Number: 5,325,741

[45] Date of Patent: Jul. 5, 1994

[54] CAN LID REMOVER

[76] Inventor: Erik J. H. Astrom, Kärrvägen 26, S-135 55 Tyresö , Sweden

[21] Appl. No.: 920,567

[22] PCT Filed: Feb. 22, 1991

[86] PCT No.: PCT/SE91/00137

§ 371 Date: Aug. 20, 1992

§ 102(e) Date: Aug. 20, 1992

[87] PCT Pub. No.: WO91/13022

PCT Pub. Date: Sep. 5, 1991

[30] Foreign Application Priority Data

Feb. 23, 1990 [SE] Sweden ..... 9000648-7

[51] Int. Cl.[5] ..... B67B 7/00

[52] U.S. Cl. ..... 81/3.37; 81/3.56

[58] Field of Search ..... 81/3.07, 3.36, 3.37, 81/3.4, 3.55, 3.56, 424.5, 426.5, 426

[56] References Cited

U.S. PATENT DOCUMENTS 2,473,870 6/1949 Eastman .
4,425,826 1/1984 Morris .

FOREIGN PATENT DOCUMENTS 1193059 10/1959 France .
2531415 2/1984 France .
448369 2/1987 Sweden .

*Primary Examiner*—Roscoe V. Parker
*Attorney, Agent, or Firm*—Keck, Mahin & Cate

[57] ABSTRACT

A can lid remover comprises a pair of mutually expandable wedge members (17, 23) which may be driven in between an outer peripheral flange (49) of a can and an outer peripheral flange (48) of a lid in adjacent initial positions in which they are located side by side in a common plane and which then may be moved to mutually expanded positions while lifting the lid flange (48) from the can flange (49). In order to facilitate a safe and convenient use thereof, the remover is also provided with a holder-up (24) which is located in front of the wedge members (17, 23) and adapted to be applied against the inner side of a cylindrical wall portion of the lid (47) and which may be moved in relation to the wedge means (17, 23) from an outer end position at a greater distance therefrom to an inner end position at a shorter distance therefrom while forcibly driving in the wedge members (17, 23) between the lid flange (48) and the can flange (49), and means (21) for releasably holding the wedge members (17, 23) in their initial positions during at least an initial portion of the movement of the holder-up (24) from its outer end position to its inner end position.

9 Claims, 1 Drawing Sheet

CAN LID REMOVER

Figure 1:
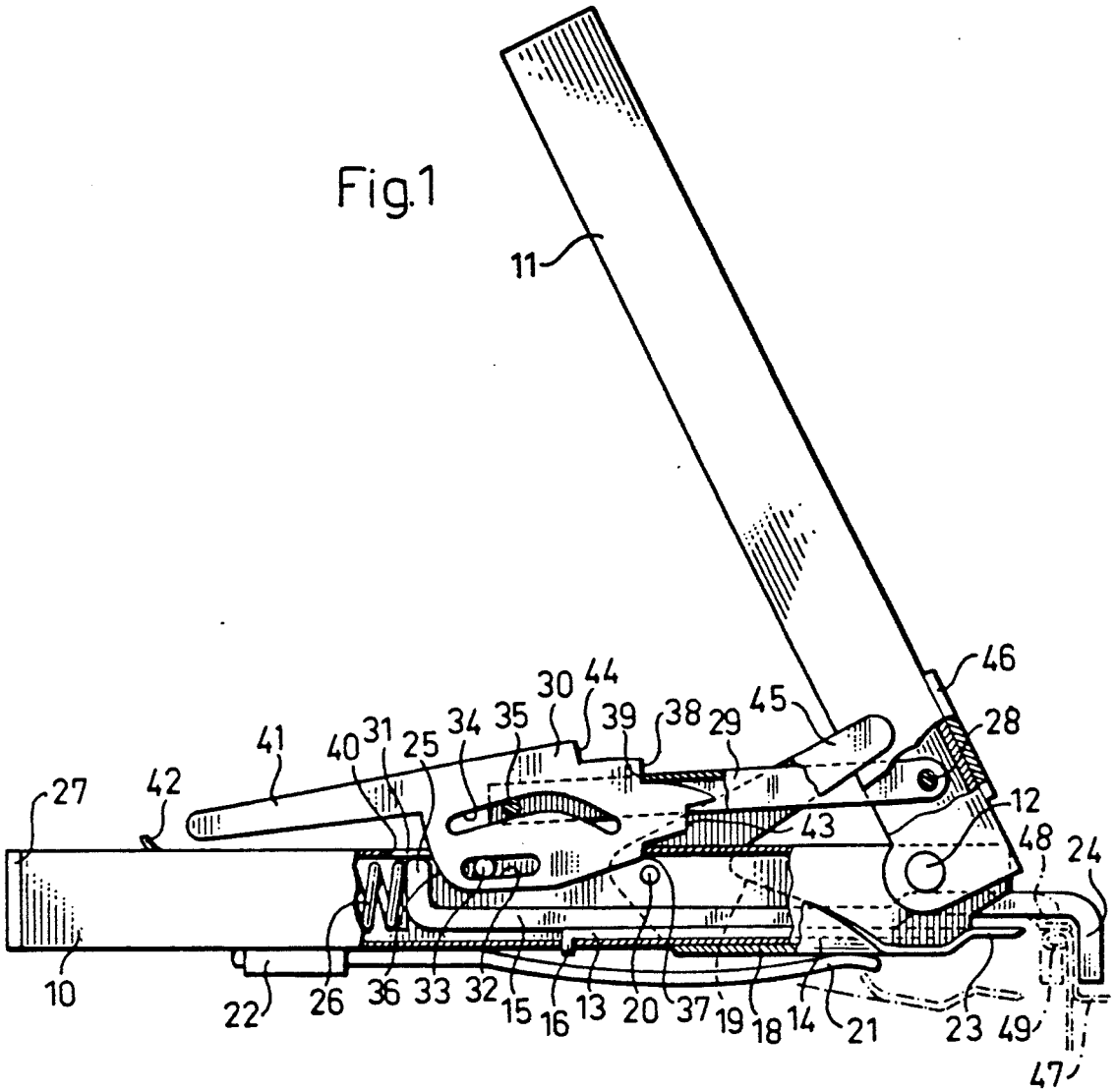

The present invention relates to a can lid remover.

More particularly, the invention relates to a can lid remover for use when opening a paint can or other can, at its upper end provided with an opening, surrounded by an outer peripheral flange and closed by a lid having a central main portion, sunk into the can opening, a cylindrical wall portion, projecting in an upward direction from said main portion, and an outer peripheral flange which is provided at the upper end of said wall portion and by means of which the lid is supported resting on said flange of the can with its cylindrical wall portion in contact with the inner side of the can, said can lid remover comprising a pair of mutually expandable wedge means which may be driven in between the lid flange and the can flange in adjacent initial positions in which they are located in side-by-side relationship in a common plane and which, after having been driven in between said two flanges, may be moved in relation to each other in a direction substantially perpendicular to said plane to mutually expanded positions while lifting the lid flange from the can flange.

A can lid remover of the above kind is previously known through SE-B 448 369. However, since this known can lid remover is difficult to handle and, in addition, easily may cause injuries, it has not found any appreciable practical use.

When driving in the two wedge means between the lid flange and the can flange, it is necessary to hold the can with one hand while holding the remover in the other hand and manually holding the two wedge means in their adjacent initial positions by means of the latter hand, and simultaneously to press the remover against the can with a sufficient force to drive in the wedge means between the two flanges. Also during the subsequent movement of the wedge means to their mutually expanded positions, it is necessary to hold the can with one hand while applying a sufficient force on the wedge means to expand them by the other hand and simultaneously still pressing the remover against the can by the latter hand in order to ensure that the wedge means will be maintained inserted between the two flanges.

In practice, the above operations cannot be carried out in a safe and reliable manner. Instead, a user runs a great risk of slipping with the remover, in which case he may cause substantial damages to the can as well as to the lid and also injure the hand by which he is holding the can, if he happens to hit this hand with the remover.

The invention has for its purpose to provide an improved can lid remover of the above kind which eliminates the drawbacks of the known remover above described.

The can lid remover, according to the invention proposed for the above purpose, is primarily characterized in that it also comprises a holder-up which is located in front of the wedge means and adapted to be applied against the inner side of the cylindrical wall portion of the lid and which may be moved in relation to the wedge means from an outer end position at a greater distance from the wedge means to an inner position at a shorter distance from the wedge means while forcibly driving in the wedge means between the lid flange and the can flange, and means for releasably holding the wedge means in their adjacent initial positions during at least an initial portion of the movement of the holder-up from its outer end position to its inner end position.

By providing the can lid remover with a holder-up of the above kind, it is possible to eliminate the prior need for holding the can with one hand. Moreover, the risk of slipping with the remover and the connected risk of damages and injuries are also eliminated.

By additionally providing the remover with means for releasably holding the wedge means in their adjacent initial positions, the use of the remover may also be substantially simplified as the wedge means need not be manually held in their desired mutual positions during the movement of driving in them between the two flanges.

In order to facilitate the desired placement of the wedge means on level with the opposed contact surfaces of the two flanges before driving in the wedge means between said surfaces, the can lid remover may advantageously also comprise an abutting means by which it may rest on the upper side of the lid flange. This abutting means may preferably be rigidly connected to the holder-up.

The abovementioned means for releasably holding the wedge means in their initial positions may suitably comprise spring means, tending to hold the wedge means in said positions. Moreover, the holder-up may preferably be spring-biased in a direction towards its outer end position. If the holder-up and the wedge means are spring-biased in the above manner, when the can lid remover is to be used, it may assume a suitable initial state without requiring any outer forces to be applied thereon for holding it in said state.

The remover may be provided with various types of manual operating means by which a user may operate the holder-up and the two wedge means. However, it may preferably be provided with two elongate handle members which are pivotally connected to each other at their one ends and which may be swung in relation to each other between predetermined first end positions and predetermined second end positions and which are arranged, when swung in relation to each other through a predetermined first angle from said first end positions and in a direction towards said second end positions, to cause a movement of the holder-up from its outer end position to its inner end position and, during continued pivoting movement thereof in said direction through a predetermined second angle, to cause a movement of the wedge means in relation to each other from their adjacent initial positions to their mutually expanded positions.

The two handle members may suitably form a greater angle with each other when they are located in their first end positions than when they are located in their second end positions. In this case, the required relative movement between the two handle members for removing a can lid will consist in a pivotal movement of them towards each other. This means that the remover may be handled by one hand in the same manner as a pair of pliers.

In a preferred embodiment of the invention, one of the two handle members is formed as a support member for the holder-up on which the latter is mounted for limited rectilinear displacement. This handle member may advantageously also serve as a support member for the two wedge means, in which case one wedge means may be rigidly connected to said handle means while the other wedge means is mounted for limited pivotal movement thereon.

Figure 2:
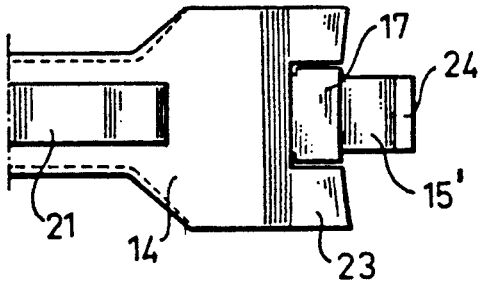

Below the invention is further described with reference to the accompanying drawing, in which:

FIG. 1 shows a side elevation, partly in section, through a can lid remover according to an embodiment of the invention, selected by way of example, and FIG. 2 shows a partial bottom plan view of the end portion of said remover located to the right in FIG. 1.

The can lid remover shown in the drawing is formed as a plier-like hand tool having two elongate handle members 10 and 11 which are pivotally connected to each other by means of a pivot pin 12. Handle member 10 consists of a tubular member having a rectangular cross-section, while handle member 11 is formed as a U-profile member.

Handle member 10 serves as a support means for two wedge members 13 and 14 and a holder-up member 15. Wedge member 13 is formed as a strip-shaped sheet metal piece which, in order to be held in a stationary position in handle member 10 is provided with a short downwardly bent rear end portion 16 by which it is anchored in a slot-shaped transversally extending opening in the lower wall of member 10. At its opposite front end, wedge member 13 has an end portion 17 projecting externally of member 10 and forming a stationary wedge means.

Wedge member 14 has a base portion 18, located below handle member 10, and two vertical side legs 19, which are bent in upward directions from said base portion and by means of which said wedge member is mounted for limited pivotal movement on member 10 by means of a transversally extending pivot pin 20. Reference numeral 21 designates a leaf spring which, at its one end, is mounted in a spring holder 22 provided at the lower side of member 10, while, at its other end, it rests against the lower side of base portion 18 of wedge member 14 and tends to hold wedge member 14 in its position shown in full lines in FIG. 1 and in which base portion 18 rests against the lower side of member 10. At its front end, located to the right in FIG. 1, wedge member 14 is formed with a fork-shaped end portion 23 (FIG. 2) forming a movable wedge means. When wedge member 14 is located in the abovementioned position shown in full lines, the two parts of end portion 23, provided in spaced-apart relationship in the transversal direction of member 14, are located adjacent to and on opposite sides of stationary wedge means 17 in a plane common with said wedge means. By rotating the wedge member 14 to the position shown in dash-dotted lines in FIG. 1, wedge means 23 may be moved a predetermined distance in a downward direction from wedge means 17.

Holder-up member 15 consists of a flat bar which is mounted for limited longitudinal displacement in member 10 and which, at its end located to the right in FIG. 1 and projecting externally of member 10, has a downwardly bent outer end portion 24 which forms a holder-up, located in front of wedge means 17 and 23. At its opposite inner end, member 15 is provided with an upwardly bent end portion 25 against which a compression spring 26, located within member 10, rests. This spring, which at its other end rests against a plug 27 inserted in member 10, pushes member 15 in a direction towards its end position shown in full lines in FIG. 1 and in which end portion 24, which acts as a holder-up, is located at a maximum distance from the two wedge means 17 and 23.

Wedge member 14 and holder-up member 15 may both be moved from their positions shown in full lines to their positions shown in dash-dotted lines by means of handle member 11, which in FIG. 1 has been shown in full lines in a readiness position. When member 11 is swung in a counter-clockwise direction from said position, it will first cause a movement of holder-up member 15 to the end position thereof shown in dash-dotted lines and in which holder-up 24 is located at a minimum distance from wedge means 17 and 23. Not until then, when swung further in said direction, wedge member 11 will cause a movement of wedge member 14 to its position shown in dash-dotted lines and in which wedge means 23 is located at a maximum distance below wedge means 17.

In order to facilitate an operation of holder-up member 15 and wedge member 14 by means of handle member 11, there is provided a linkage consisting of a link 29, pivotally connected to member 11 by means of a pivot pin 28, and a plate 30, connected to member 10 for limited tilting movement and displacement in relation to said member. This plate projects partially into member 10 through a slot-shaped longitudinal opening 31 in the upper wall of said member and has a lower shorter elongate opening 22, which receives a pivot and guide pin 33 secured to member 10, and an upper longer elongate opening 34, which receives a guide and pivot pin 35 secured to link 29.

In the illustrated position, plate 30 rests with an edge surface 36 thereof against an upper edge portion of the inner end portion 25 of holder-up member 15, while it rests against the foremost edge surface of opening 31 in member 10 with a shoulder 37. Link 29, which consists of a partially slotted U-profile member, has an edge surface 39 by which it rests against a shoulder 38 of plate 30. Hereby, by means of member 11 and link 29, plate 30 may be moved in a direction to the left until it hits the rear edge surface 40 of opening 31 with its edge surface 36. Through the action of the projecting finger 41 of plate 30 and a guide tongue 42 bent in an upward direction from member 10, plate 30 will then be tilted through a small angle in a clockwise direction around pin 33, whereby a shoulder 43 is inserted in front of the foremost edge surface of opening 31 and brought into engagement with the latter to hold plate 30. Simultaneously, shoulder 38 and edge surface 39 are brought out of engagement with each other, which means that handle member 11 may then be swung further in a counter-clockwise direction until edge surface 39 strikes a shoulder 44 of plate 30, now located in front of said edge surface.

During the abovementioned movement of plate 30 in a direction to the left, said plate will drive the holder-up member 15 to its inner end position. The subsequent continued pivotal movement of handle member 11, during which member 15 remains in said end position, has for its purpose to cause a rotation of wedge member 14 in a clockwise direction around pivot pin 40. For this purpose, wedge member 14 is provided with two arms 45 which project in inclined upward and forward directions form side legs 19 and are arranged to cooperate with a cam plate 46 which is mounted on handle member 11 and projects a short distance on each side of member 11.

Arms 45 have such a length as to ensure that they will not be actuated by cam plate 46 until holder-up member 15 has reached its inner end position and link 29 has been brought out of engagement with shoulder 38 of plate 30. When cam plate 46 has reached arms 45, the continued rotation of handle member 11 to the position shown in dash-dotted lines will cause a rotation of wedge member 14 in a downward direction against the action of spring 21.

When wedge member 14 has reached its lower end position, which may be determined by the length of the portion of opening 34, which in the situation illustrated in FIG. 1 is located to the left of pin 35, through the action of spring 21, handle member 11 will be swung in a clockwise direction until base portion 18 of wedge member 14 again has been brought into contact with member 10. In order then to rotate member 11 further in said direction a manual lifting force has to be applied on said member. This force is transmitted from member 11 to plate 30 over link 29 and pin 35 at the right-hand downwardly slanting portion of opening 34, whereby plate 30 is swung in an upward direction and shoulder 43 is brought out of engagement with the front edge surface of opening 31. Plate 30 then releases holder-up member 15, whereby said member may be returned to its outer end position through the action of spring 26.

The horizontal portion 15' of member 15 located adjacent to holder-up 24 may suitably be located at such a short distance above the stationary wedge means 17 as to enable it to serve as a support means which, when placed resting on flange 48 of a can lid 47, may position wedge means 17 and 23 on level with the opposed contact surfaces of lid flange 48 and can flange 49.

The invention is not restricted to the embodiment above described and shown in the drawing. Instead, many alternative embodiments are feasible within the scope of the invention.

I claim:

1. Can lid remover for use when opening a paint can or other can, at its upper end provided with an opening, surrounding by an outer peripheral flange (49) and closed by means of a lid (47) having a central main portion, sunk into the can opening, a cylindrical wall portion, projecting in an upward direction from said main portion, and an outer peripheral flange (48) which is provided at the upper end of said wall portion and by means of which the lid (47) is supported resting on said flange (49) of the can with its cylindrical wall portion in contact with the inner side of the can, said can lid remover comprising a pair of mutually expandable wedge means (17, 23) which may be driven in between the lid flange (48) and the can flange (49) in adjacent initial positions in which they are located in side-by-side relationship in a common plane and which, after having been driven in between said two flanges, may be moved in relation to each other in a direction substantially perpendicular to said plane to mutually expanded positions while lifting the lid flange (48) from the can flange (49), characterized in that it also comprises a holder-up (24) which is located in front of the wedge means (17, 23) and adapted to be applied against the inner side of the cylindrical wall portion of the lid (47) and which may be moved in relation to the wedge means (17, 23) from an outer end position at a greater distance from these means to an inner end position at a shorter distance from these means while forcibly driving in the wedge means (17, 23) between the lid flange (48) and the can flange (49), and means (21) for releasably holding the wedge means (17, 23) in their adjacent initial positions during at least an initial portion of the movement of the holder-up (24) from its outer end position to its inner end position.

2. Can lid remover according to claim 1, characterized in that it also comprises an abutting means (15') by which it may rest on the upper side of the lid flange (48).

3. Can lid remover according to claim 2, characterized in that said abutting means (15') is rigidly connected to the holder-up (24).

4. Can lid remover according to claim 1 characterized in that said means for releasably holding the wedge means (17, 23) in their initial positions comprise spring means (21), tending to hold the wedge means (17, 23) in said positions.

5. Can lid remover according to claim 1 characterized in that the holder-up (24) is spring-biased towards its outer end position.

6. Can lid remover according to claim 1 characterized in that it is provided with two elongate handle members (10, 11) which are pivotally connected to each other at their one ends and which may be swung in relation to each other between predetermined first end positions and predetermined second end positions and which are adapted, when swung in relation to each other through a predetermined first angle from said first end positions and in a direction towards said second end positions, to cause a movement of the holder-up (24) from its outer end position to its inner end position and, during continued pivoting movement thereof in said direction through a predetermined second angle, to cause a movement of the wedge means (17, 23) in relation to each other from their adjacent initial positions to their mutually expanded positions.

7. Can lid remover according to claim 6, characterized in that the two handle members (10, 11) form a greater angle with each other when located in their first end positions than when located in their second end positions.

8. Can lid remover according to claim 6, characterized in that one (10) of the two handle members is formed as a support member for the holder-up (24) in which the latter is mounted for limited rectilinear displacement.

9. Can lid remover according to claim 8, characterized in that said one handle member (10) also serves as a supporting member for the two wedge means (17, 23), one wedge means (17) being rigidly connected to said handle means (10) while the other wedge means (23) is mounted for limited pivotal movement thereon.

* * * * *